United States Patent [19]

Podesta

[11] 4,176,757

[45] Dec. 4, 1979

[54] GASKET FOR CLOSURE CAPS FOR CONTAINERS

[76] Inventor: Armando Podesta, 36, Corso Buenos Aires, Milan, Italy

[21] Appl. No.: 901,695

[22] Filed: May 1, 1978

[30] Foreign Application Priority Data

May 2, 1977 [IT] Italy ..... 12584 A/77

[51] Int. Cl.[2] ..... B65D 53/00

[52] U.S. Cl. ..... 215/341; 428/66

[58] Field of Search ..... 215/341, 349, 350, 343, 215/345, 342, 270; 428/66

[56] References Cited

U.S. PATENT DOCUMENTS

| | | | |
|---|---|---|---|
| 3,092,281 | 6/1963 | Davidson | 215/349 X |
| 3,235,114 | 2/1966 | Blackwood | 215/350 |

FOREIGN PATENT DOCUMENTS

| | | | |
|---|---|---|---|
| 207065 | 3/1957 | Australia | 215/349 |
| 292032 | 10/1953 | Switzerland | 215/341 |
| 804613 | 11/1958 | United Kingdom | 215/341 |

*Primary Examiner*—Donald F. Norton

*Attorney, Agent or Firms*—Larson, Taylor and Hinds

[57] ABSTRACT

A gasket for closure caps made from a plastics foil and comprising a disc portion, a skirt depending from the disk portion and a peripheral flange extending radially outwardly from the lower edge of said skirt. Whenever the cap with this gasket is applied on the container to be closed, the skirt of the gasket is folded into a bellows-like manner with respect to the peripheral flange and the disc portion of the gasket thus providing a very efficient seal between the cap and the container rim.

2 Claims, 8 Drawing Figures

GASKET FOR CLOSURE CAPS FOR CONTAINERS

STATEMENT OF THE PRIOR ART KNOWN

The following prior art is known to the applicant: -U.K. Pat. Nos. 769,259 (RICAI), 1,203,068 (LOY BROS.), 1,228,653 (ISAMU NISHIKAWA).

BACKGROUND AND SUMMARY OF THE INVENTION

This invention relates to closure caps such as screw caps and crown caps for the closure of glass containers, such as bottles, flasks, and the like, and more particularly it relates to the gaskets for use in such caps in order to provide a tight seal even at a rather high pressure in a glass container, such as it would be the case with bottles containing gas saturated liquids, such as beer or soft drinks.

The gasket according to the invention is made from a plastics foil, particularly a polyethylene or polypropylene foil, in form of a pan-shaped element comprising a disc portion, a skirt depending from the disc portion, and a peripheral flange extending outwardly from the skirt of the gasket.

According to a main feature of the invention, the skirt of the gasket is folded, upon applying the cap on the container to be closed, into a bellows-like manner between the cap bottom and the rim of the container, thus providing a very efficient seal through a simple change in its shape, without any deformation of the material of which it is made, which seal is assured with a much lower cap tightening or clamping pressure than that required for prior art gaskets.

This invention is also concerned with a method of manufacturing the above mentioned gaskets.

Further objects and advantages of the invention will be apparent from the following description of the preferred embodiment of the gasket according to the invention and of the method for manufacturing it, made with reference to the accompanying drawings.

DESCRIPTION OF A FIRST EMBODIMENT OF THE INVENTION

Figure 1:
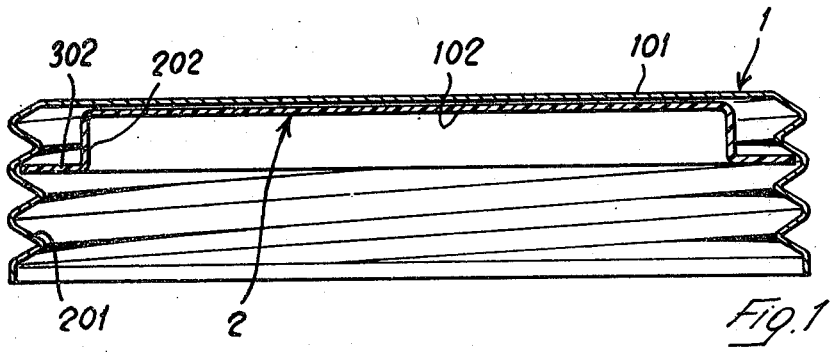
FIG. 1 is a longitudinal sectional view of a gasket according to the invention fitted in a screw cap.
Figures 2A, 2B:
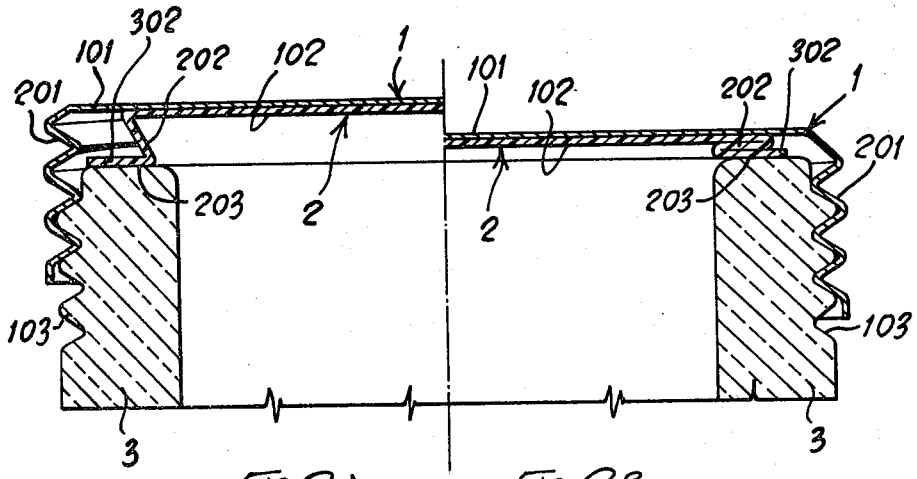
FIGS. 2A and 2B are view similar to FIG. 1 showing two different steps of a container-sealing operation.

In FIGS. 1, 2A and 2B a first embodiment of the invention is shown. With reference to the said figures, numeral 1 denotes a screw cap, comprising a disc portion 101, and a generally cylindrical screw threaded skirt 201 depending from the periphery of the disc portion 101.

Inside of the screw cap 1, the gasket 2 is disposed. The said gasket, which is made from a thin foil of plastics material, comprises a disc portion 102, a generally cylindrical skirt 202 depending from the periphery of the disc portion 102, and a flange portion 302 extending radially outwardly from the lower end of the skirt 202.

In use, the cap 1 with the gasket 2 is fitted to a container provided with a generally cylindrical neck 3 having external ribs 103 forming an external screw thread which co-operates with the screw thread 201 of the cap 1, so that the cap can be screwed onto the neck of the container. When the cap is screwed onto the neck 3 of the container to be closed (not shown), the flange portion 302 of the gasket 2 comes at first onto abutment with the rim 203 of the neck 3, and as the cap is tightened, the skirt portion 202 flexes inwardly in a bellows-like manner between the flange portion 302 and the disc portion 102 of the gasket 2, (position of FIG. 2A), until it disposes itself parallel to the flange 302 and the disc portion 102, as shown in FIG. 2B.

By using a gasket according to the invention, it is thus possible to obtain, starting from a gasket made from a very thin foil of plastics material, a very efficient seal, thanks to the fact that in the sealing zone, that is in the zone between the rim 203 of the neck 3 and the peripheral cooperating zone of the bottom of the cap 1, the gasket 2 assumes, thanks to the superimpositions of the flange portion 302, the skirt portion 202 and the peripheral portion of the disc 102, a thickness which is sufficient to compensate for irregularities in the rim surface and/or in the cooperating surface of the cap bottom. Moreover, it will be evident that the said sealing will be also improved by any gas pressure acting from the inside of the container on the folds of the gasket 2.

Figure 4:
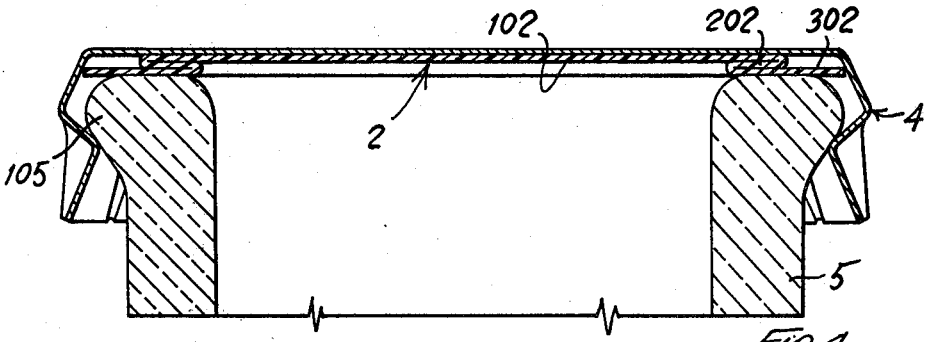
FIG. 4 is a longitudinal section of the crown cap and gasket of FIG. 3, clamped on the bead of the neck of a glass container.
Figure 3:
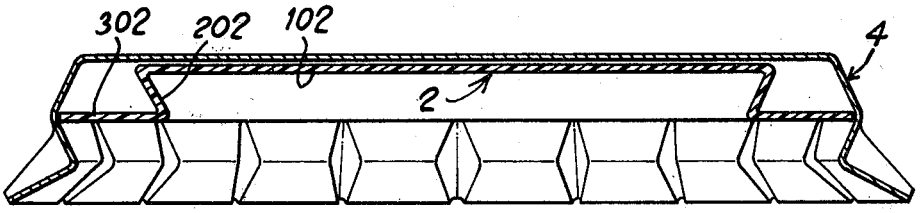
FIG. 3 is a longitudinal section of a gasket according to the invention fitted in a crown cap.

In FIGS. 3 and 4, it is shown the use of a gasket similar to the one above described in use with a crown-type cap, instead as with a screw-cap. In this case, the neck 5 of the container to be closed will be provided, in usual manner, with an annular bead 105 round its mouth.

METHOD OF MANUFACTURING OF THE GASKETS ACCORDING TO THE INVENTION

According to the invention, a method is provided for the manufacture of a gasket which behaves in the above described manner, that is in which the skirt portion will flex, whenever compressed, in a bellows like manner, which is made from a thin foil of plastics material, and for instance a thin foil of polyethylene or polypropylene.

The said method of manufacture as well as the means used for carrying it into effect, will now be described with reference to FIGS. 5 to 7.

Figure 5:
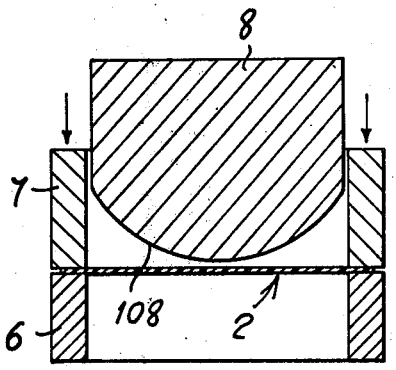
FIGS. 5, 6 and 7 are longitudinal sections of a die for forming the gaskets according to the invention which sequentially show the different manufacturing steps of a gasket according to the invention.
Figure 6:
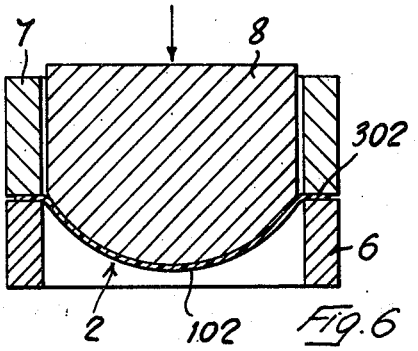
Figure 7:
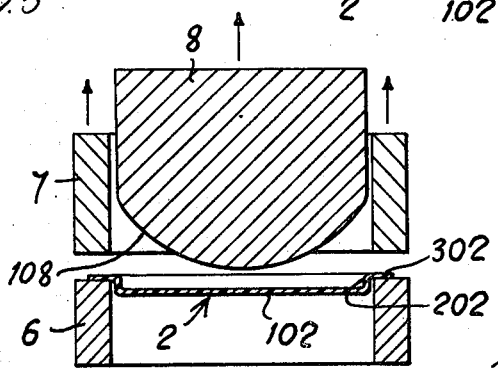

With reference to the said FIGS. 5 to 7, the device for cold-forming the gaskets 2 according to the invention comprises a tubular die formed by a tubular supporting element 6 and a tubular fastener 7. The supporting element 6 and the fastener 7 have the same diameter, and are co-axially mounted. The element 6 is fixed, whilst the fastener 7 is supported axially movable to and fro with respect to the element 6. Numeral 8 denotes a cylindrical punch, having an outer diameter which is slightly lesser than the inner diameter of the die 6, 7, the said punch being supported concentrically to the die 6, 7 and axially reciprocable with respect to the said die. The punch 8 is provided at its lower punching end with a convex spherical surface 108. In operation, blanked disc 2, of a thin foil of for instance polyethylene, is positioned on the supporting element 6, with its peripheral edge lying on the peripheral edge on the said element 6. Thereafter the fastener 7 is moved downwardly, into contact with the upper surface of the peripheral edge of the blank 2, thus firmly clamping said blank against the element 6. Thereafter, the punch 8 is caused to slide downwardly, thus stretching with its convex spherical head 108 the surface of the blank clamped in the die 6, 7. Thereafter, the punch 8 is lifted again to its starting position, and the fastener 7 is also lifted out of contact with the blank 2. Due to its stretching, and the following shrinkage occurring on releasing the pressure of punch 8, the disc 101 is caused to assume the pan-shaped configuration shown in FIG. 7, with the flange 302, the skirt 202 and the disc portion 102. The cold formed gasket 2 thus obtained, has surprisingly displayed the feature that, whenever subjected to an axial compression, its skirt 202 will fold in the above described bellows-like manner, thus enabling the effects of the invention.

I claim:

1. In a closure for containers comprising a closure cap having a disc portion, a skirt depending from the periphery of the disc portion, means for fastening said skirt to the neck of a container to be closed, and a gasket disposed adjacent said disc portion of the closure cap for sealing contact with a rim of a neck of a container to be closed, the improvement wherein said gasket is made of a thin foil of plastics material and has a disc portion adjacent the disc portion of said closure cap, a cylindrical skirt portion depending from the periphery of said disc portion and a flange portion extending radially outwardly from the lower end of said skirt portion, whereby as the gasket is compressed between said closure cap and a rim of a neck of a container, said skirt portion will flex inwardly in a bellows-like manner thereby providing three layers of gasket material between the rim and the closure cap, said three layers being formed by said flange portion, said cylindrical skirt portion, and said disc portion.

2. A gasket for a closure cap for containers comprising a closure cap having a disc portion, a skirt depending from the periphery of the disc portion, a means for fastening said skirt to the neck of a container to be closed, said gasket being adapted to be positioned between said disc portion of said closure cap and a rim of a neck of a container to be closed, said gasket being made of a thin foil of plastics material and having a disc portion adapted to be positioned adjacent the disc portion of said closure cap, a cylindrical skirt portion depending from the periphery of said disc portion and a flange portion extending radially outwardly from the lower end of said skirt portion, whereby as the gasket is compressed between said closure cap and a rim of a neck of a container, said skirt portion will flex inwardly in a bellows-like manner thereby providing three layers of gasket material between the rim and the closure cap, said three layers being formed by said flange portion, said cylindrical skirt portion, and said disc portion.

* * * * *